US005530971A

United States Patent [19]

Anderson

[11] Patent Number: 5,530,971

[45] Date of Patent: Jul. 2, 1996

[54] ODOR CONTROL SYSTEM FOR TOILETS

[76] Inventor: Donald C. Anderson, P.O. Box 1057, Lafayette, Calif. 94549

[21] Appl. No.: 439,701

[22] Filed: May 12, 1995

Related U.S. Application Data

[63] Continuation-in-part of Ser. No. 207,752, Aug. 3, 1994, abandoned.

[51] Int. Cl.[6] ..... E03D 9/05

[52] U.S. Cl. ..... 4/215

[58] Field of Search ..... 4/213, 215, 216, 4/217

[56] References Cited

U.S. PATENT DOCUMENTS

| | | | |
|---|---|---|---|
| 470,740 | 3/1892 | Bluhm | 4/217 |
| 900,831 | 10/1908 | Charlton | 4/217 |
| 980,916 | 1/1911 | Borger et al. | 4/215 |
| 1,449,250 | 3/1923 | Ribley | 4/217 |
| 2,021,402 | 11/1935 | Blodgett | 4/215 |
| 2,309,925 | 2/1943 | Schotthoefer | 4/215 |
| 3,333,285 | 8/1967 | Null | 4/217 |
| 3,579,650 | 5/1971 | Sloan | 4/215 X |
| 3,605,126 | 9/1971 | Henry | 4/215 X |
| 3,790,970 | 2/1974 | Bendersky et al. | 4/217 |
| 4,433,441 | 2/1984 | Schroeder | 4/217 |
| 4,586,201 | 5/1986 | Todd | 4/217 |

FOREIGN PATENT DOCUMENTS

| | | | |
|---|---|---|---|
| 0339381 | 4/1936 | Italy | 4/215 |

*Primary Examiner*—Charles E. Phillips

[57] ABSTRACT

An odor control system for capturing odoriferous air from toilet bowls, removing the odor bodies from the air, and returning the cleansed air to the room. A fine water spray nozzle (32) in a duct (30) transfers kinetic energy to the air stream, and also absorbs odor bodies from the air. Energy to generate the water spray and draw air through a ventilated toilet seat is provided by the water under pressure which supplies the usual toilet function. System is started and stopped as needed by the person using the toilet. Supplemental filter (36), e.g. Activated carbon, improves odor cleansing by adsorption. Spray water used is separated from air stream and returned to toilet bowl (20) through check valve (38).

1 Claim, 1 Drawing Sheet

ODOR CONTROL SYSTEM FOR TOILETS

Figure 1:
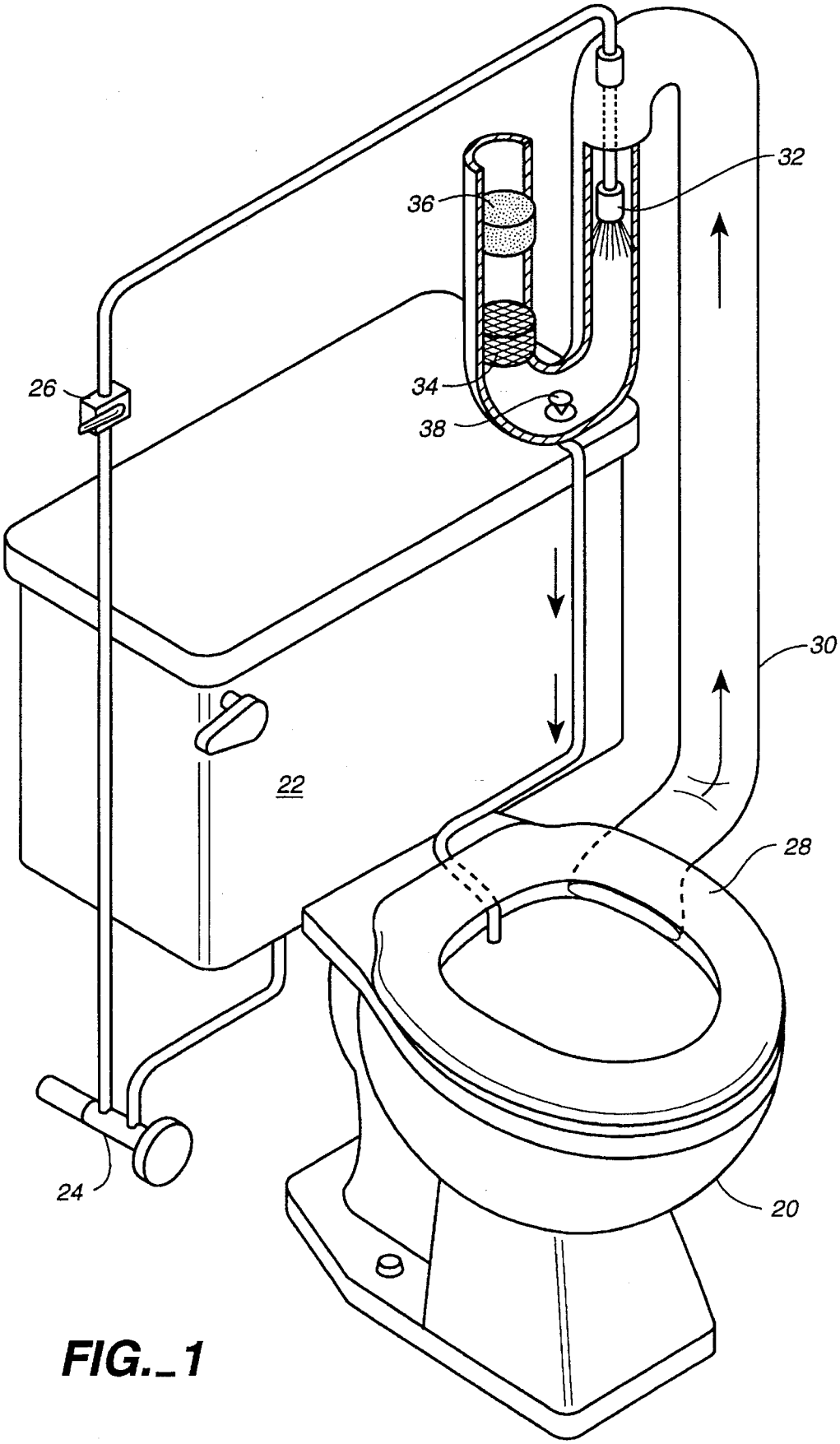

This is a C.I.P. of application Ser. No. 08/207/752, filed Aug. 3, 1994, now abandoned.

BACKGROUND

1. Field of Invention

Western civilization has long considered the odor of human feces to be objectionable, and in fact, has long sought for means to minimize the release of odors resulting from defecation in bathrooms. Many home bathrooms are equipped with ceiling fans which exhaust air from a point high above the origin of the odors, the toilet bowl. These fans are only marginally effective, and in fact, must exhaust very large air volumes to prevent the escape of odor bodies into the rest of the home.

2. Prior Art

In addition to fans built into the bathroom ceiling, there have been numerous attempts to develop "ventilated toilet seats", designed to capture odors at the toilet bowl and exhaust them out of the room. The prior art, Class 4, Subclass 217, is rich with hollowed toilet seats, mechanical exhaust fans operated by electric motors or various mechanical drive means, all ducting objectionable gases either through the wall to the outside, or to an available sewer vent pipe in the bathroom wall. One patent, #900,831, H. W Charlton, Oct. 13, 1908, teaches the use of a water-powered fan wheel, using available water pressure as the energy source to drive the fan. Others teach the use of air-water ejectors to energize air flow from the toilet bowl to the sewer pipe or the vent pipe.

Notwithstanding the potential of these prior attempts to solve the bathroom odor-control problem, no fully adequate and commercially acceptable solution has been found. In most cases, the energy source is not convenient or reliable (or in the case of electricity, safe), and the need to exhaust odors from the room results in the need to modify the structure, which is costly and beyond the scope of do-it-yourself work. #900,831 Charlton does provide the convenient water pressure energy source, but fails to address the problem of extracting the odors from the room.

OBJECTS AND ADVANTAGES

The primary object of the present invention is to provide a complete, reliable, safe, and inexpensive method of containing and destroying potentially embarrassing and unpleasant odors before they can escape from a toilet into the bathroom air.

Another related object is to accomplish the foregoing task with an energy source readily available at the toilet, and not dangerous, as is the case with an electric fan.

Another related object is to control the odors without having to exhaust air to the outside of the bathroom, thus saving energy costs in heating and air-conditioning.

Another related object is to save water by eliminating multiple flushings, which are commonly employed to reduce escaping odors.

Another related object is to accomplish the odor control by combining the functions of (1) generating air flow, and (2) eliminating odors, with no moving mechanical parts required.

Another related object is to accomplish all of the foregoing with a device so simple that it can be assembled and put into service by a typical do-it-yourself family member, while requiring no structural changes to the bathroom, the plumbing, or the existing toilet bowl and tank.

DESCRIPTION

The foregoing ends are attained by means set forth below in a description of one preferred embodiment of this invention.

By directing a fine water spray down an air duct, two necessary functions are accomplished: (1) energy from the water spray is transferred to entrained air molecules, generating air flow in the duct, and (2) the fine water spray particles absorb odor bodies from the air stream. Both of these functions are well-known independent industrial processes, known as air-water ejectors, and odor absorbers, respectively. The upstream end of the duct is connected to a hollow (ventilated) toilet seat. The air/water spray mixture then passes through an entrainment separator mesh, following which the cleansed (deodorized) air returns to the room, and the water to the toilet bowl. Certain features which are possibly included in various embodiments of this invention are:

a. A hollow toilet seat with one or more orifices facing inward to the toilet bowl, all connecting to a main duct which leads in turn to the fine water spray odor absorber.

b. A water supply on-off valve, easily adapted for connection to the existing toilet tank water supply fittings.

c. A mesh entrainment separator located immediately downstream of the fine spray odor absorber, functioning to coalesce the water droplets, causing them to fall out of the air stream.

d. The addition of an optional activated carbon filter located downstream of the entrainment separator to capture by adsorption any odor bodies which may have escaped the odor absorber.

e. A water supply on-off valve which may be either manual or linked to the toilet seat and actuated automatically by the weight of the person using the toilet.

f. A float check valve to allow return of spray water to the toilet bowl without leaking ventilation air back to the bowl.

DRAWINGS

In the drawings, FIG. 1 is a schematic diagram showing the apparatus removing toilet odors by means of this invention.

The toilet bowl (20) and tank (22) are supplied with water from the main house supply through one of the two outlets of duplex supply valve (24). This valve is a direct replacement for the conventional toilet supply valve which normally has only one outlet fitting. The second outlet fitting of supply valve (24) leads to manual stopcock (26), which is the control which starts and stops the function of this invention.

The special toilet seat (28) is hollow, and has holes on the inside surface, placed to capture and remove odoriferous air from the bowl before it escapes into the room. This seat (28) is connected, for purposes of directing air flow, to a duct (30), which houses, in sequence, shown in cutaway, the fine water spray odor absorber nozzle (32) mounted in one leg of a U-shaped configuration, an entrainment separator (34), and an optional activated carbon filter (36) mounted in another leg of the U-shaped configuration.

OPERATION

In operation, the user opens the stopcock (26), causing flow of a fine spray of water from the nozzle (32), which action transfers kinetic energy to the air and thus draws odoriferous air from the toilet bowl (20), preventing its escape into the room. The intermingling of the air with the fine spray results in odor bodies being absorbed by the water. As is well known in the field of odor absorber design, air flow generated by the spray should be as low as possible to maximize the exposure of odoriferous air to water droplets. So long as the velocity of the air through openings defined by the user's body and the toilet seat exceeds approximately 100 feet per minute, the escape of odors is prevented. It is critical that the spray nozzle type and pattern be selected primarily for the ability to thoroughly intermix fine water droplets with the air stream, to achieve good absorbing action. Adequate air flow has been produced through a 2.5 in. diameter duct with a fine spray nozzle using only 0.33 gallons/minute of water. Most of the spray water collects directly at the float check valve (38), and returns to the toilet bowl by gravity. Fine mists of water are coalesced by the entrainment separator (34), and also fall down and through the float check valve (38). The optional activated carbon filter (36) adsorbs any remaining odor bodies from the air stream before it is returned to the room.

Thus it can be seen from the foregoing description that the odor control system of FIG. 1 achieves the stated objects of the invention, eliminating odors from the vicinity of the toilet, returning the cleansed air to the room, without the need for any mechanical moving parts or electrically driven devices. Retrofit of an existing toilet requires only the simplest hand tools to replace the existing seat and water supply valve.

RAMIFICATIONS

Although the description above is specific as it applies to a single configuration of elements for use in toilet odor control, there can be many variations in designs, as well as applications, of this invention. The air intakes at the toilet seat can have many shapes and locations, the nozzle can have a variety of patterns and spray angles consistent with good intermixing and odor absorbing performance, and the entire system can be separate, as a retrofit, or integrated in a new toilet design. Furthermore, the core concept of combining functions of generating air flow plus absorbing odors could be employed in other arenas, such as reducing or eliminating explosive gases, where a system free of electricity and moving mechanical parts is essential.

Having thus described this invention, what is claimed as novel and desired to be secured by Letters Patent of the United States is:

1. An odor control system for use with a conventional water tank and bowl combination located in a room, said system comprising:

an exhaust duct leading from said toilet bowl to a location above said water tank and forming a U-shaped configuration having an outlet opening at the top of one leg of said configuration;

said exhaust duct having a fine water spray nozzle located within said duct at the other end of said configuration, said nozzle being capable of producing intense intermingling of air from said bowl with water from said nozzle;

a valved conduit connectable at one end to a toilet water source, said valved conduit connected at another end to said fine water spray nozzle, an entrainment separator located in said exhaust duct in said one leg downstream from said fine water spray nozzle, a return conduit connected to said exhaust duct via a check valve between said fine water spray nozzle and said entrainment separator in the base of said configuration for permitting water sprayed from said nozzle and water entrained by said separator to drain by gravity into said toilet bowl; characterized in that said fine water spray nozzle imparts enough kinetic energy to the air in said exhaust duct to exhaust odors from said bowl, preventing their escape into the room, and simultaneously, by absorbing action, the fine water spray from said fine water spray nozzle removes sufficient odor bodies from the ducted air, to permit its return to the room as clean and odor-free air through said outlet opening.

* * * * *